US008531495B2

(12) United States Patent
Yoshida

(10) Patent No.: US 8,531,495 B2
(45) Date of Patent: Sep. 10, 2013

(54) PRINTER, RECORDING PAPER POSITIONING METHOD, AND RECORDING MEDIUM STORING A PROGRAM EXECUTED BY A CONTROL UNIT THAT CONTROLS A PRINTER

(75) Inventor: Ryo Yoshida, Ueda (JP)

(73) Assignee: Seiko Epson Corporation, Tokyo (JP)

( * ) Notice: Subject to any disclaimer, the term of this patent is extended or adjusted under 35 U.S.C. 154(b) by 132 days.

(21) Appl. No.: 13/283,535

(22) Filed: Oct. 27, 2011

(65) Prior Publication Data

US 2012/0105567 A1 May 3, 2012

(30) Foreign Application Priority Data

Oct. 28, 2010 (JP) ..... 2010-241854

(51) Int. Cl.
*B41J 11/00* (2006.01)

(52) U.S. Cl.
USPC ..... 347/218

(58) Field of Classification Search
USPC ..... 347/9, 5, 14, 16, 104, 105, 164, 165, 347/168, 171, 197, 198, 215, 218, 220, 221; 400/611, 612, 624, 625
See application file for complete search history.

(56) References Cited

U.S. PATENT DOCUMENTS

| | | | | |
|---|---|---|---|---|
| 5,873,507 | A | 2/1999 | Suzuki | |
| 2004/0061768 | A1* | 4/2004 | Nishimura | 347/218 |
| 2010/0074635 | A1 | 3/2010 | Sakurai | |
| 2011/0242179 | A1* | 10/2011 | Mori | 347/16 |
| 2011/0298860 | A1* | 12/2011 | Yoshida | 347/16 |
| 2012/0019580 | A1* | 1/2012 | Tokushima | 347/14 |

FOREIGN PATENT DOCUMENTS

| | | | |
|---|---|---|---|
| JP | 05-042730 | A | 2/1993 |
| JP | 09-300749 | A | 11/1997 |
| JP | 2008-238484 | A | 10/2008 |

* cited by examiner

*Primary Examiner* — Kristal Feggins
(74) *Attorney, Agent, or Firm* — Kilpatrick Townsend & Stockton LLP

(57) ABSTRACT

A printer detects black marks BM formed at a constant interval along the length of recording paper by a detector disposed to the recording paper conveyance path at a position upstream from a printing position, positions the recording paper to a printing start position for printing on the recording paper based on the detection results from the detector, and positions the recording paper to a cutting position downstream from the printing position in order to cut the recording paper based on detection of a black mark BM after printing ends. When a power-off command is input, the printer starts conveying the recording paper forward, stops conveying the recording paper when a black mark BM is detected by the detector after conveyance starts, and then turns the power off.

14 Claims, 4 Drawing Sheets

PRINTER, RECORDING PAPER POSITIONING METHOD, AND RECORDING MEDIUM STORING A PROGRAM EXECUTED BY A CONTROL UNIT THAT CONTROLS A PRINTER

BACKGROUND

Priority is claimed under 35 U.S.C. §119 from Japanese patent application no. JP 2010-241854 filed on Oct. 28, 2010, which is hereby incorporated by reference in their entirety.

1. TECHNICAL FIELD

The present invention relates to a printer that prints on recording paper (continuous paper), and relates more particularly to a program and a recording paper positioning method for a printer that positions the recording paper based on positioning marks provided at a constant interval along the length of the recording paper.

2. RELATED ART

Printers that repeatedly print to specific intervals on continuous recording paper and cut the paper by means of a paper cutter to issue receipts, coupons, and similar output are known from the literature. Some printers of this type print index marks, also called black marks or positioning marks herein, that are used for positioning the paper at specific intervals along the length of the recording paper, and position the recording paper to the printing start position and cutting position, for example, based on these index marks. Holes or notches that can be detected by a mechanical or optical sensor may also be used instead of black marks as the index marks. The gaps between labels may also be detected as the index marks on label paper, a type of continuous paper having labels affixed at a specific interval to a web liner. A printer that prints to continuous paper having such index marks is taught in Japanese Unexamined Patent Appl. Pub. JP-A-2008-238484, for example.

Printers that print on continuous recording paper having index marks do not know where the index marks on the recording paper are located (that is, do not know where the paper is positioned) when the power turns on or the paper is replaced, and therefore must first detect an index mark on the recording paper and then position the recording paper to an initial position. As a result, printers according to the related art convey the recording paper to detect an index mark, position the recording paper to the cutting position of the paper cutter based on the detected index mark, cut off the leading end of the paper, and position the recording paper to the initial position.

When the power is off, the cover to the recording paper storage compartment of the printer may be opened and the recording paper pulled out by the user for some reason, resulting in the leading end of the recording paper being pulled significantly forward from the paper exit and the cutting position of the paper cutter. When this happens and the cover is then closed and the power turned on, the recording paper is fed further forward in order to position the recording paper to the initial position. As a result, the length of the leader extending passed the cutting position may be greater than the length of one receipt or coupon, increasing the amount of recording paper wasted in the positioning operation. If the amount the recording paper is conveyed for this positioning operation is great, more time is required for the initial positioning operation, and the recording paper cannot be quickly positioned.

SUMMARY

A recording paper positioning method for a printer and a printer that positions recording paper using this method of the invention enable positioning recording paper to the correct position without wasting recording paper when the power turns on, for example.

A first aspect of the invention is a method of positioning recording paper in a printer, including steps of: detecting positioning marks formed at a constant interval along the length of the recording paper by a detector disposed to the recording paper conveyance path at a position upstream from a printing position; positioning the recording paper to a printing start position for printing on the recording paper based on detection of the positioning mark by the detector; and when a power-off command is input, starting conveying the recording paper forward; stopping conveyance of the recording paper when the positioning mark is first detected by the detector after starting the forward conveyance operation; and then performing a power-off process.

When a power-off command is input from a host computer, for example, a printer according to the invention executes a recording paper positioning operation to position the recording paper so that the first positioning mark at the leading end of the recording paper is positioned where it can be detected by the detector, and then turns off. Therefore, if the next time the power turns on the position of the recording paper has not changed, the recording paper will already be positioned where the positioning mark can be detected by the detector. As a result, a positioning operation to convey the recording paper to detect the positioning mark and position the recording paper based thereon is not necessary, and recording paper is not wasted.

A positioning mark should normally be detectable once the recording paper has been conveyed at least the distance between positioning marks. Therefore, if the recording paper is conveyed forward and a positioning mark is not detected after the paper is conveyed the distance between positioning marks, conveying the recording paper is stopped and an error can be returned.

A method of positioning recording paper in a printer according to another aspect of the invention also has steps of determining if the positioning mark was detected by the detector when the printer power turns on; determining that the recording paper is positioned if the positioning mark is detected; and if the positioning mark is not detected, determining that the recording paper is in an offset position, and positioning the recording paper by starting conveying the recording paper in reverse and then stopping conveying the recording paper when the first positioning mark is detected by the detector after conveyance starts.

Because the recording paper is positioned when the power turns off, this aspect of the invention can know that the position of the previously positioned recording paper has shifted if the positioning mark is not detected by the detector when the power turns on. When the cover to the recording paper compartment is opened and the recording paper is pulled out while the power is off, or when the recording paper is accidentally pulled out from the paper exit while the power is off, the recording paper will normally be shifted so that the positioning mark on the recording paper is moved downstream in the conveyance direction from the detector position. As a result, the first positioning mark at the leading end of the recording paper can be detected in the shortest time by conveying the recording paper in reverse, and the recording paper can be positioned based thereon. The recording paper positioning operation can therefore be completed in a short time when the power turns on, and recording paper is not wasted by cutting off the leading end of the paper when positioning the paper.

A positioning mark should normally be detectable once the recording paper has been conveyed at least the distance between positioning marks. Therefore, if the recording paper is conveyed in reverse and a positioning mark is not detected after the paper is conveyed the distance between positioning marks, conveying the recording paper is stopped and an error can be returned.

The recording paper positioning operation can be executed as follows when printing. That is, whether or not a positioning mark was detected by the detector is determined when a print command is input. If the positioning mark is detected, the recording paper is positioned to the printing start position by conveying the recording paper a predetermined distance in reverse. If the positioning mark is not detected, it is determined that an error occurred.

The recording paper can be positioned for cutting after printing as follows. That is, the recording paper is conveyed further forward after printing ends, conveying the recording paper stops when the positioning mark is detected by the detector, and the recording paper is then positioned to a paper cutting position located downstream from the printing position by conveying the recording paper a predetermined amount in reverse.

Another aspect of the invention is a printer including: a printhead; a conveyance mechanism that conveys recording paper through a conveyance path passed a printing position of the printhead; a detector disposed to the recording paper conveyance path at a position upstream from a printing position for detecting positioning marks formed at a constant interval along the length of the recording paper; and a control unit that controls positioning the recording paper conveyed through the conveyance path based on detection of the positioning mark by the detector, positions the recording paper to a printing start position for printing on the recording paper based on detection of the positioning mark by the detector, and when a power-off command is input, starts conveying the recording paper forward by the conveyance mechanism, stops conveying the recording paper when the positioning mark is first detected by the detector after starting the forward conveyance operation, and then performs a power-off process.

Another aspect of the invention is a computer-readable recording medium storing a program executed by a control unit that controls a printer, the program causing the control unit to execute steps of: detecting positioning marks formed at a constant interval along the length of the recording paper by a detector disposed to the recording paper conveyance path at a position upstream from a printing position; positioning the recording paper to a printing start position for printing on the recording paper based on detection of the positioning mark by the detector; and when a power-off command is input, starting conveying the recording paper forward; stopping conveyance of the recording paper when the positioning mark is first detected by the detector after starting the forward conveyance operation; and then performing a power-off process.

EFFECT OF THE INVENTION

When a power-off command is input to a printer according to the invention, the printer executes a recording paper positioning operation to position the recording paper so that the first positioning mark at the leading end of the recording paper is positioned where it can be detected by the detector, and then turns off. Therefore, if the next time the power turns on the position of the recording paper has not changed, the recording paper will already be positioned where the positioning mark can be detected by the detector. As a result, a positioning operation to convey the recording paper to detect the positioning mark and position the recording paper based thereon is not necessary, and recording paper is not wasted.

Because the recording paper is positioned when the power turns off, this aspect of the invention can know that the position of the previously positioned recording paper has shifted if the positioning mark is not detected by the detector when the power turns on. Because shifting of the recording paper position generally results in the positioning mark on the recording paper moving downstream in the conveyance direction from the detector position, the first positioning mark at the leading end of the recording paper can be detected in the shortest time by conveying the recording paper in reverse, and the recording paper can be positioned based thereon. The recording paper positioning operation can therefore be completed in a short time when the power turns on, and recording paper is not wasted by cutting off the leading end of the paper when positioning the paper.

Other objects and attainments together with a fuller understanding of the invention will become apparent and appreciated by referring to the following description and claims taken in conjunction with the accompanying drawings.

BRIEF DESCRIPTION OF THE DRAWINGS

FIG. 4 is a flow chart of the recording paper positioning operation of the printer when the power turns on.

DESCRIPTION OF EMBODIMENTS

A preferred embodiment of a printer according to the present invention is described below with reference to the accompanying figures.

Figure 1B:
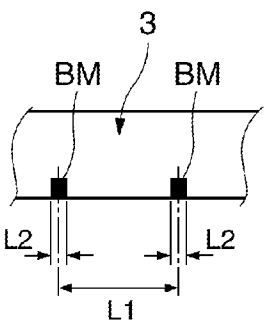
FIG. 1B shows the back side of recording paper to which the invention can be applied.
Figure 1A:
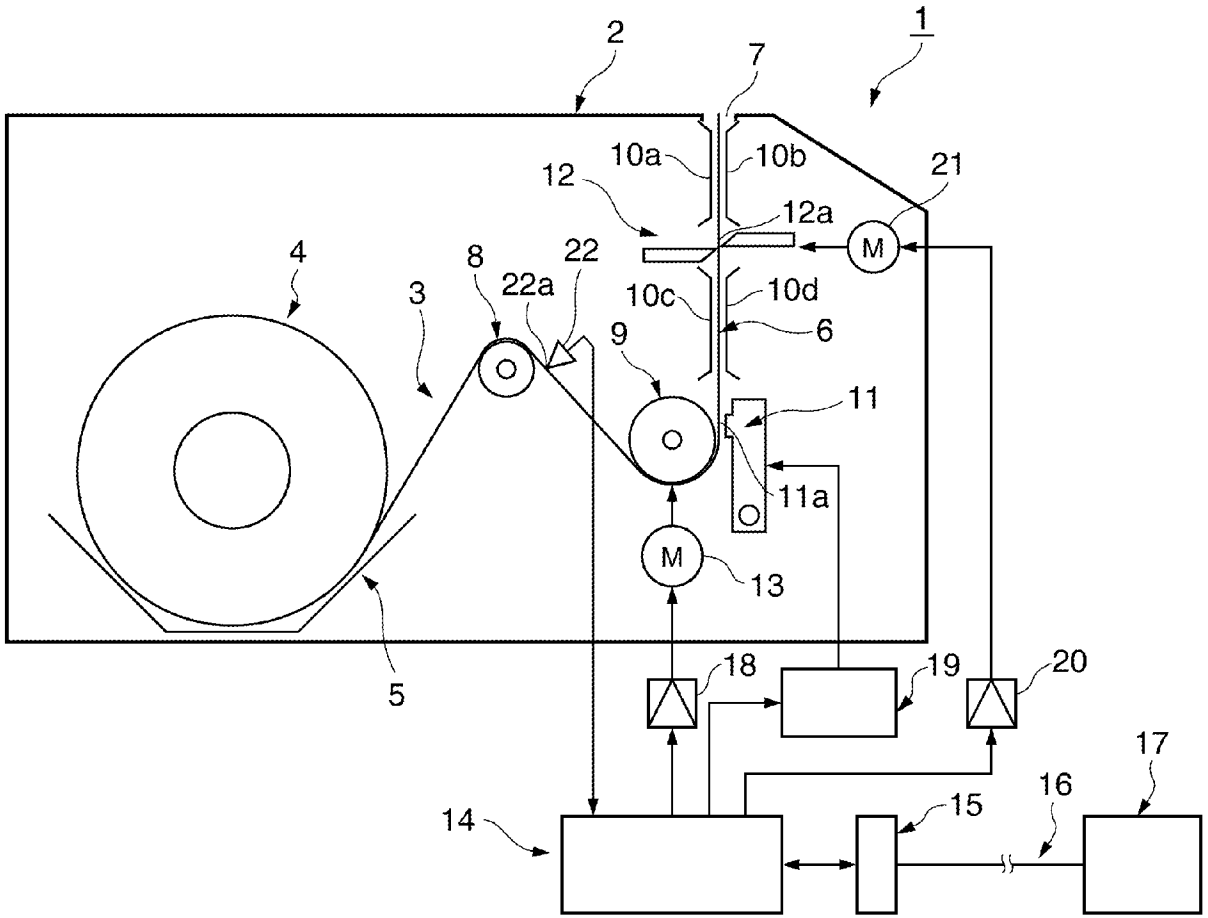
FIG. 1A schematically describes a printer according to the invention.

Referring to FIG. 1A, a printer 1 according to this embodiment of the invention has a storage compartment 5 for roll paper 4, which is a continuous length of recording paper 3 of a specific width wound into a roll, inside the printer case 2. The recording paper 3 pulled from the storage compartment 5 is conveyed through a conveyance path 6 formed inside the case 2 to the paper exit 7. The conveyance path 6 is defined by a guide roller 8, platen roller 9, and a plurality of paper guides 10*a* to 10*d*. A thermal head (printhead) 11 is pressed to the platen roller 9 with the recording paper 3 therebetween. A cutter 12 is disposed between the paper exit 7 and the printing position 11*a* of the thermal head 11, and the cutter 12 can cut the recording paper 3 at the cutting position 12*a*.

The platen roller 9 is rotationally driven by a paper feed motor 13, the recording paper 3 is conveyed to and discharged from the paper exit 7 by rotation of the platen roller 9 while being pressed against the printing surface of the thermal head 11, and the paper feed conveyance mechanism is rendered by the platen roller 9 and paper feed motor 13. Specific content is printed on the face of the recording paper 3 by driving the thermal head 11 synchronized to conveyance of the recording paper 3.

A control unit 14 composed of a CPU, ROM, and RAM controls driving the printer 1. The control unit 14 executes a control program stored in ROM, controls driving other printer parts, and conveys, positions, and prints on the recording paper 3 according to commands input from a host computer 17 connected through a communication unit 15 and communication line 16. In the recording paper 3 conveyance and positioning operation, the control unit 14 controls conveyance of the recording paper 3 by the platen roller 9 that is driven by the paper feed motor 13 through a motor driver 18. In the recording paper 3 printing operation, the control unit 14 controls recording paper 3 conveyance and driving the thermal head 11 through a head driver 19, and performs the process of printing print data supplied from the host computer 17 on the recording paper 3. The control unit 14 also controls driving the cutter motor 21 through a motor driver 20 to cut the recording paper 3 by means of the cutter 12.

A detector 22 for detecting black marks BM (positioning marks or index marks) disposed on the recording paper 3 as index marks is also disposed on the upstream side of the printing position 11*a* of the thermal head 11.

As shown in FIG. 1B, rectangular black marks BM of a specific length L2 are printed at a regular interval L1 on the back side of the recording paper 3 along the length thereof in the conveyance direction. The detector 22 is a transmissive or reflective photosensor, for example. Information related to the interval L1 and length L2 of the black marks BM is previously stored in the control unit 14, or is input from the host computer 17. The control unit 14 positions the recording paper 3 based on interval L1, length L2, and the black mark BM detection results from the detector 22.

Figure 2:
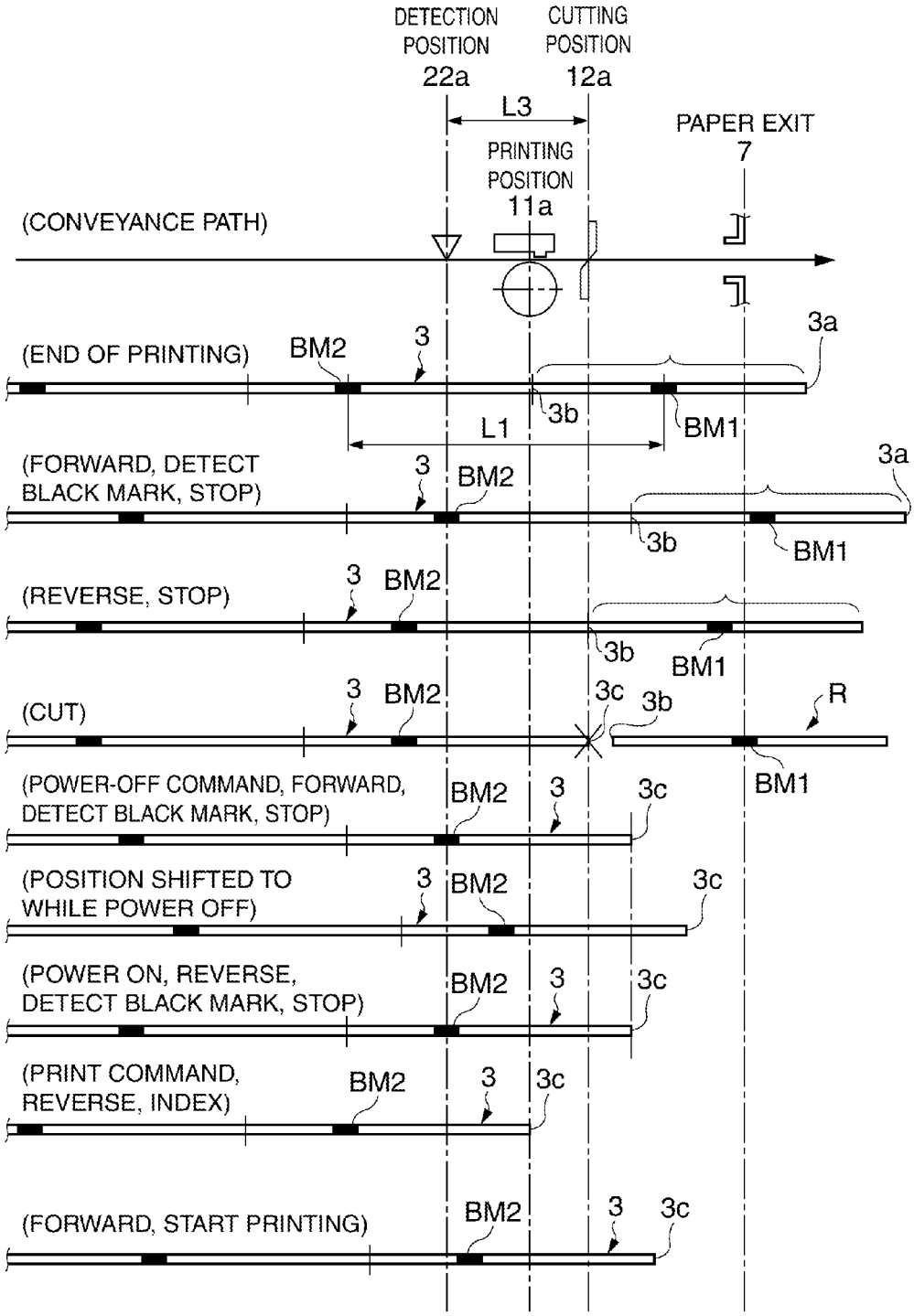
FIG. 2 describes the recording paper positioning operation of the printer.

FIG. 2 describes positioning the recording paper 3 in the printer 1. As shown in FIG. 2, a detector 22 detection position 22*a*, thermal head 11 printing position 11*a*, and cutter 12 cutting position 12*a* are located along the conveyance path 6 of the printer 1. In this embodiment of the invention, the distance L3 from the detection position 22*a* to the cutting position 12*a* is less than or equal to half the interval L1 between the black marks BM, and the distance from the detection position 22*a* to the paper exit 7 is substantially equal to interval L1. It will be obvious to one with ordinary skill in the related art that these dimensions are simply one example, and the invention is not limited to these relative dimensions.

When printing ends, the leading end 3*a* of the recording paper 3 protrudes slightly forward from the paper exit 7 as indicated by (end of printing) in FIG. 2, and the black mark BM1 at the leading end of the recording paper 3 is located between the cutting position 12*a* and the paper exit 7. The end-of-printing position 3*b* on the recording paper 3 is also at the printing position 11*a*.

After printing ends, the recording paper 3 is conveyed forward and conveyance of the recording paper 3 stops when the second black mark BM2 is detected by the detector 22 as indicated by (forward, detect black mark, stop) in FIG. 2. The end-of-printing position 3*b* of the recording paper 3 is located forward (downstream) from the cutting position 12*a*.

Note that "forward" as used herein refers to conveyance of the recording paper 3 forward from the upstream side to the downstream side of the conveyance path. The recording paper 3 is conveyed in "reverse" when conveyed in the opposite direction.

The recording paper 3 is then conveyed a predetermined distance in the reverse direction so that the end-of-printing position 3*b* of the recording paper 3 is positioned to the cutting position 12*a*. The (reverse, stop) position shown in FIG. 2 shows the recording paper 3 positioned to the cutting position 12*a*. The second black mark BM2 is located behind (on the upstream side of) the detection position 22*a* of the detector 22, for example, at this time. After the recording paper 3 is thus positioned to the cutting position 12*a*, the cutter 12 is driven and cuts across the width of the end-of-printing position 3*b* of the recording paper 3 as indicated by (cut) in FIG. 2. The printed portion of the recording paper 3 is thus issued as a receipt R of a specific length. The leading end 3*c* of the recording paper 3 after printing ends and the paper is cut is thus always positioned to the cutting position 12*a*.

Positioning Recording Paper when the Power Turns Off

Figure 3:
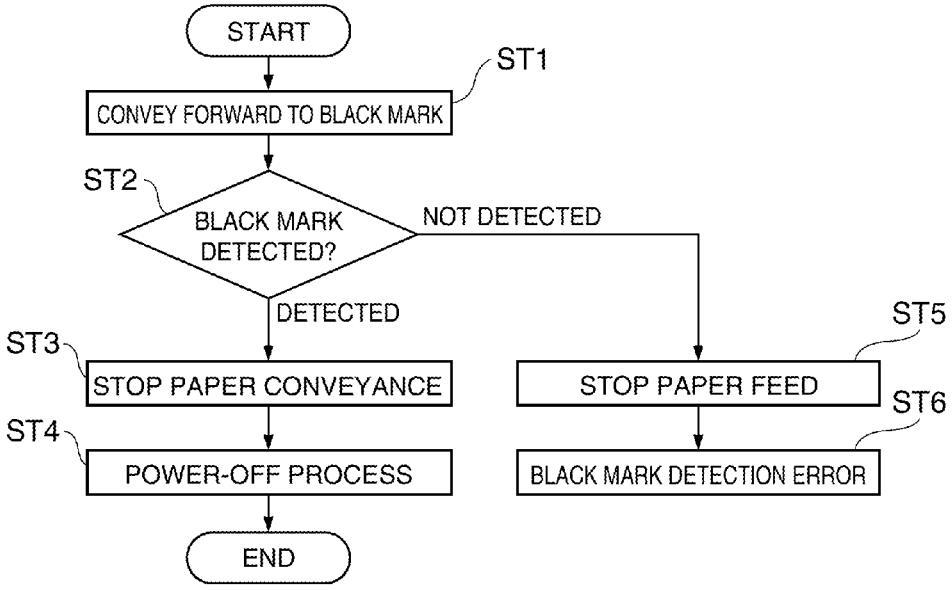
FIG. 3 is a flow chart of the recording paper positioning operation of the printer when the power turns off.

When a power-off command for turning the printer 1 power off is received from the host computer 17, the printer 1 executes the recording paper 3 positioning operation shown in the flow chart in FIG. 3 and indicated by (power-off command, forward, detect black mark, stop) in FIG. 2.

As described with reference to these figures, when a power-off command is received, the recording paper 3 starts conveying the recording paper 3 forward (FIG. 3, step ST1: convey forward to black mark). After this conveyance operation starts, the recording paper 3 monitors if black mark BM2 on the recording paper 3 is detected by the detector 22 (FIG. 3, step ST2: black mark detected?). If the black mark BM2 is detected (FIG. 3, step ST2 returns Detected), recording paper 3 conveyance stops (FIG. 3, step ST3: stop paper conveyance). The power-off process then executes and operation ends (FIG. 3, step ST4: power-off process).

As a result, printer 1 power turns off after positioning the black mark BM2 at the leading end of the recording paper 3 to the detection position 22*a* of the detector 22.

When the recording paper 3 is conveyed normally, a black mark BM should be detected before the forward conveyance distance of the recording paper 3 equals the interval L1 between black marks BM. Because a no-paper error, detector error, or other problem is determined to have occurred if a black mark BM is not detected when the recording paper 3 has been conveyed interval L1, control goes from step ST2 in FIG. 3 to step ST5 (stop paper feed), conveying the recording paper 3 stops, and an error is reported to the user in step ST6 (black mark detection error).

Positioning the Recording Paper when Power Turns on

The recording paper 3 is held as positioned while the power is off unless the recording paper 3 is pulled out manually. This means that when the power turns on, the recording paper 3 is positioned as shown in the (power-off command, forward, detect black mark, stop) line in FIG. 2, and the leading black mark BM2 on the recording paper 3 is detected by the detector 22. When the power turns on, it is therefore unnecessary to convey the recording paper 3, find a black mark BM2, and position the recording paper 3. Recording paper 3 is therefore also not wasted because there is no need to cut off the leading end of the recording paper 3. The leading end 3*c* can also be positioned to the printing position 11*a* with the shortest conveyance distance based on the position of the black mark BM2, the distance L1 to the black mark BM2, and length L2 as indicated by (print command, reverse, index) in FIG. 2.

If the operator opens the cover (not shown in the figure) of the storage compartment 5 and pulls out the recording paper 3, or pulls the recording paper 3 out from the paper exit 7, while the power is off, the recording paper 3 will be moved from where it was positioned when the power turned off.

Figure 4:
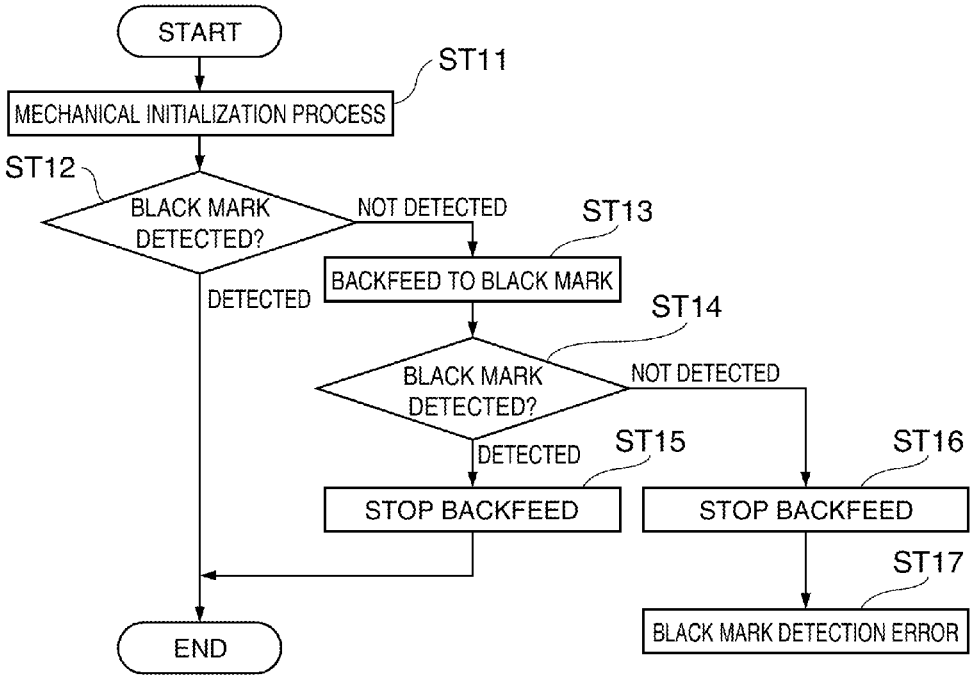

The printer 1 therefore detects if the position of the recording paper 3 has shifted, and repositions the recording paper 3 if a shift is detected when the power turns on as indicated by (position shifted to while off) and (power on, reverse, detect black mark, stop) in FIG. 2 and the flow chart in FIG. 4.

More specifically, after the initialization process is executed when the printer power turns on (FIG. 4, ST11: mechanical initialization), the detector 22 determines if the black mark BM2 was detected (step ST12: black mark detected?). If it was detected, the recording paper 3 is desirably positioned and the positioning operation is not required as described above.

However, if the recording paper 3 was pulled out and the black mark BM2 is not detected as indicated by (position shifted while off) in FIG. 2, the recording paper 3 is determined to be out of position, control goes from step ST12 in FIG. 4 to step ST13 (backfeed to black mark), and the recording paper 3 is conveyed in reverse. After conveyance starts, the printer 1 monitors if the black mark BM2 is detected by the detector 22 (FIG. 4, step ST14: black mark detected?). If detected, control goes to step ST15 in FIG. 4 (stop backfeed) and paper conveyance stops. The recording paper 3 is thus returned to the desired position and positioned for printing as indicated by (power on, reverse, detect black mark, stop) in FIG. 2.

As described above, whether or not the position of the recording paper 3 has shifted is detected when the printer power turns on, and if the position has shifted, the recording paper 3 is conveyed in reverse until the detector 22 detects the black mark BM2 at the leading end of the recording paper 3. Positioning the recording paper 3 when the power turns on can therefore be completed in a short time, and recording paper is not wasted by cutting off the leading end of the recording paper 3.

Note that if a black mark BM2 is not detected even after reversing the recording paper 3 a distance equal to the interval L1 between the black marks BM when the power turns on, control goes from step ST14 to step ST16 (stop backfeed) in FIG. 4, and an error is reported to the operator in step ST17 (black mark detection error).

Positioning Recording Paper at the Start of Printing

Positioning the recording paper at the start of printing is described next with reference to (print command, reverse, index) and (forward, start printing) in FIG. 2, and the flow chart in FIG. 5.

Figure 5:
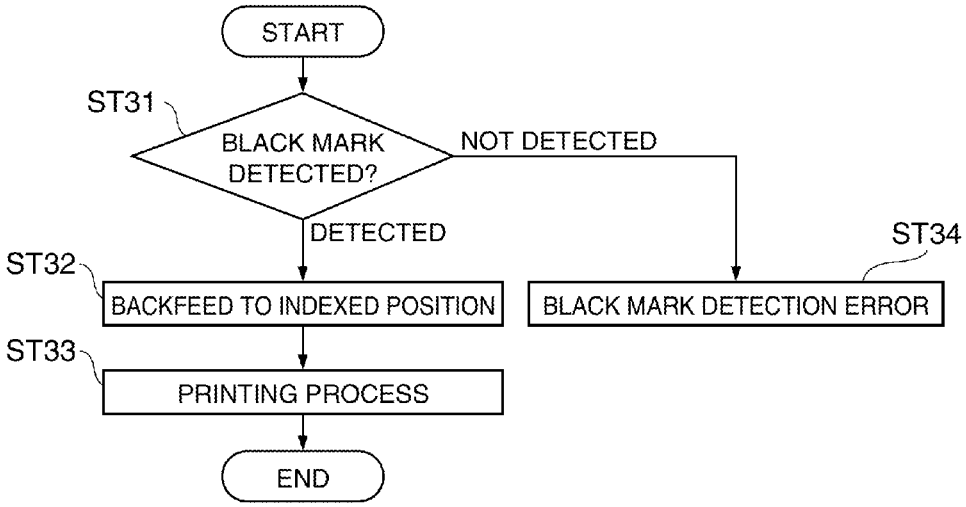
FIG. 5 is a flow chart of the recording paper positioning operation of the printer when printing starts.

When a print command is input from the host computer 17, the printer 1 first checks if the black mark BM2 was detected by the detector 22 (FIG. 5, step ST31: black mark detected?). If a black mark BM2 was detected as indicated by (power on, reverse, detect black mark, stop) in FIG. 2, the printer 1 determines the recording paper 3 is desirably positioned and conveys the recording paper 3 a predetermined amount in reverse to position the recording paper 3 to the printing start position (FIG. 5, step ST32: backfeed to indexed position). The recording paper 3 is thus positioned as indicated by (print command, reverse, index) in FIG. 2 and the printing operation starts (FIG. 5, step ST33: printing process). This printing position is indicated in FIG. 2 by (forward, start printing).

If a black mark BM2 is not detected by the detector 22, an error is displayed without starting printing (FIG. 5, step ST34: black mark detection error), and the error is reported to the operator.

The recording paper 3 may be label paper with labels affixed to a liner. In this case the black marks are printed on the liner at a known interval, and these black marks can be detected by the detector 22 for positioning. Alternatively, the detector 22 can detect the liner between adjacent labels instead of detecting black marks for positioning. When such label paper is used, a label peeling mechanism that peels the labels from the liner can be used instead of a cutter 12.

The processes executed by the printer according to the foregoing embodiment of the invention can also be embodied as a program. This program can also be provided stored on a recording medium such as a hard disk drive, optical disc, magneto-optical disc, or flash memory.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A method of positioning recording paper in a printer, comprising steps of:

detecting positioning marks formed at a constant interval along the length of the recording paper by a detector disposed to the recording paper conveyance path at a position upstream from a printing position;

positioning the recording paper to a printing start position for printing on the recording paper based on detection of the positioning mark by the detector; and when a power-off command is input, starting conveying the recording paper forward;

stopping conveyance of the recording paper when the positioning mark is first detected by the detector after starting the forward conveyance operation; and then performing a power-off process.

2. The method of positioning recording paper in a printer described in claim 1, further comprising a step of:

stopping conveying the recording paper and determining that an error occurred when the positioning mark is not detected after the recording paper is conveyed forward a distance equal to the interval between positioning marks.

3. The method of positioning recording paper in a printer described in claim 1, further comprising steps of:

determining if the positioning mark was detected by the detector when the printer power turns on;

determining that the recording paper is positioned if the positioning mark is detected; and if the positioning mark is not detected, determining that the recording paper is in an offset position, and positioning the recording paper by starting conveying the recording paper in reverse and then stopping conveying the recording paper when the first positioning mark is detected by the detector after conveyance starts.

4. The method of positioning recording paper in a printer described in claim 3, further comprising a step of:

stopping conveying the recording paper and determining that an error occurred when the positioning mark is not detected even after the recording paper is conveyed in reverse a distance equal to the interval between positioning marks.

5. The method of positioning recording paper in a printer described in claim 3, further comprising a step of:

determining if the positioning mark was detected by the detector when a print command is input;

positioning the recording paper to the printing start position by conveying the recording paper a predetermined distance in reverse if the positioning mark is detected; and determining that an error occurred if the positioning mark is not detected.

6. The method of positioning recording paper in a printer described in claim 5, further comprising a step of:

printing to the recording paper while conveying the recording paper forward from the printing start position;

further conveying the recording paper forward after printing ends and stopping conveying the recording paper when the positioning mark is detected by the detector; and then positioning the recording paper to a paper cutting position located downstream from the printing position by conveying the recording paper a predetermined amount in reverse.

7. A printer comprising:

a printhead;

a conveyance mechanism that conveys recording paper through a conveyance path passed a printing position of the printhead;

a detector disposed to the recording paper conveyance path at a position upstream from a printing position for detecting positioning marks formed at a constant interval along the length of the recording paper; and a control unit that controls positioning the recording paper conveyed through the conveyance path based on detection of the positioning mark by the detector, positions the recording paper to a printing start position for printing on the recording paper based on detection of the positioning mark by the detector, and when a power-off command is input, starts conveying the recording paper forward by the conveyance mechanism, stops conveying the recording paper when the positioning mark is first detected by the detector after starting the forward conveyance operation, and then performs a power-off process.

8. The printer described in claim 7, wherein:

the control unit stops conveying the recording paper and determines that an error occurred when the positioning mark is not detected after the recording paper is conveyed forward a distance equal to the interval between positioning marks.

9. The printer described in claim 7, wherein:

the control unit determines if the positioning mark was detected by the detector when the printer power turns on, determines that the recording paper is positioned if the positioning mark is detected, and if the positioning mark is not detected, determines that the recording paper is in an offset position, and positions the recording paper by starting conveying the recording paper by the conveyance mechanism in reverse and then stopping conveying the recording paper when the first positioning mark is detected by the detector after conveyance starts.

10. The printer described in claim 9, wherein:

the control unit stops conveying the recording paper and determines that an error occurred when the positioning mark is not detected even after the recording paper is conveyed in reverse a distance equal to the interval between positioning marks.

11. The printer described in claim 9, wherein:

the control unit determines if the positioning mark was detected by the detector when a print command is input, positions the recording paper to the printing start position by conveying the recording paper a predetermined distance in reverse if the positioning mark is detected, and determines that an error occurred if the positioning mark is not detected.

12. The printer described in claim 11, wherein:

the control unit prints to the recording paper while conveying the recording paper positioned at the printing start position forward by the conveyance mechanism and printhead, further conveys the recording paper forward after printing ends and stopping conveying the recording paper when the positioning mark is detected by the detector, and then positions the recording paper to a paper cutting position located downstream from the printing position by conveying the recording paper a predetermined amount in reverse.

13. The printer described in claim 7, further comprising:

a recording paper cutter at a position on the conveyance path downstream from the printing position;

wherein the control unit prints to the recording paper while conveying the recording paper positioned at the printing start position forward by the conveyance mechanism and printhead, further conveys the recording paper forward after printing ends and stopping conveying the recording paper when the positioning mark is detected by the detector, and then positions the recording paper to a paper cutting position located downstream from the printing position by conveying the recording paper a predetermined amount in reverse.

14. A computer-readable recording medium storing a program executed by a control unit that controls a printer, the program causing the control unit to execute steps of:

detecting positioning marks formed at a constant interval along the length of the recording paper by a detector disposed to the recording paper conveyance path at a position upstream from a printing position;

positioning the recording paper to a printing start position for printing on the recording paper based on detection of the positioning mark by the detector; and when a power-off command is input, starting conveying the recording paper forward;

stopping conveyance of the recording paper when the positioning mark is first detected by the detector after starting the forward conveyance operation; and then performing a power-off process.

* * * * *